United States Patent [19]

Grenga

[11] Patent Number: 4,460,161

[45] Date of Patent: Jul. 17, 1984

[54] GUARD RAIL AND REFLECTIVE STRIP

[76] Inventor: Joseph R. Grenga, 5498 Glenwood Ave., Youngstown, Ohio 44512

[21] Appl. No.: 471,505

[22] Filed: Mar. 2, 1983

[51] Int. Cl.[3] ..... A01K 3/00; E01F 15/00

[52] U.S. Cl. ..... 256/13.1; 116/63 R; 404/16

[58] Field of Search ..... 256/13.1; 350/105; 404/16; 116/63 P, 63 C, 63 R

[56] References Cited

U.S. PATENT DOCUMENTS

| | | | |
|---|---|---|---|
| 2,047,436 | 7/1936 | Shepherd | 256/13.1 |
| 3,190,178 | 6/1965 | McKenzie | 116/63 P |
| 3,214,142 | 10/1965 | Brown et al. | 256/13.1 |
| 3,452,799 | 7/1969 | Hindin et al. | 350/105 X |
| 3,950,873 | 4/1976 | Stehle | 116/63 P X |
| 4,000,882 | 1/1977 | Penton | 256/13.1 |

FOREIGN PATENT DOCUMENTS

| | | | |
|---|---|---|---|
| 1917931 | 10/1970 | Fed. Rep. of Germany | 256/13.1 |
| 1263300 | 5/1961 | France | 116/63 R |

*Primary Examiner*—Andrew V. Kundrat
*Attorney, Agent, or Firm*—Harpman & Harpman

[57] ABSTRACT

A guard rail and reflective strip is comprised of a modified guard rail having additional compound curved surfaces into which a reflective strip is secured. The reflective strip is preferably formed of an elastic material having a reflective surface backed with an adhesive layer. The strip conforms to the compound curves in the guard rail providing a parabolic reflective surface for the lights of an oncoming vehicle.

4 Claims, 4 Drawing Figures

GUARD RAIL AND REFLECTIVE STRIP

BACKGROUND OF THE INVENTION

1. Field of the Invention

This invention relates to guard rails having reflective structures that are applied thereon to reflect the lights of oncoming vehicles.

2. Description of the Prior Art

Prior art devices of this type have utilized a variety of different structures that are secured to and extend outwardly from the surface of the guard rails. See for example U.S. Pat. Nos. 3,214,142 and 4,000,882.

In U.S. Pat. No. 3,214,142 a highway barrier structure is disclosed having a number of differently shaped ridged structures that are secured to the rail at various points.

U.S. Pat. No. 4,000,882 discloses a cushioned structure that is secured to the center portion of the rail and presents a relatively flat reflective surface.

Applicant's invention relies on an elongated flexible strip that conforms to the curvature of the modified guard rail and presents a parabolic reflective surface to increase the visibility of the guard rail to oncoming vehicles at night.

SUMMARY OF THE INVENTION

A guard rail and reflective strip that has a highly reflective surface backed by an adhesive coating that is positioned on the concave portion of a modified guard rail. The strip is elastic and conforms to the compound curved concave shape of the rail concentrating the reflective light of oncoming vehicles making for improved night visibility.

DESCRIPTION OF THE PREFERRED EMBODIMENT

Figure 1:
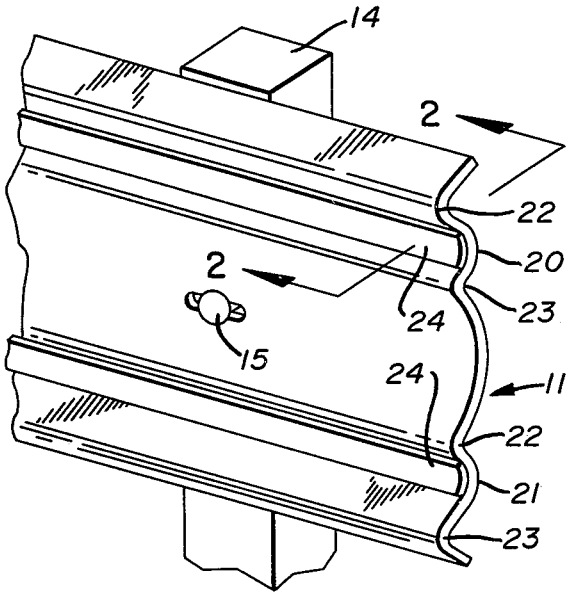
FIG. 1 is a perspective view of a portion of a modified guard rail with the reflective strips attached thereto.
Figure 3:
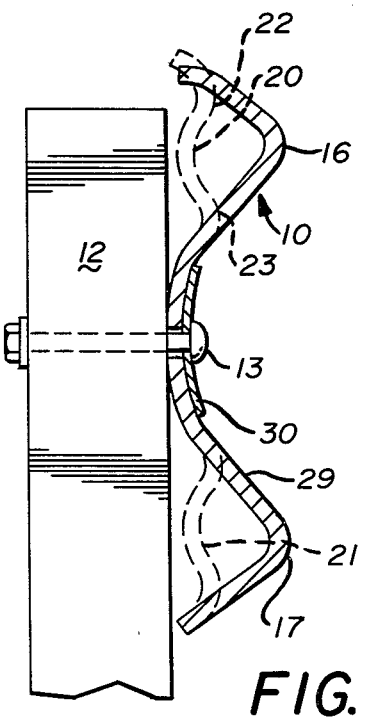
FIG. 3 is a cross section of a typical guard rail with the reflective strip attached thereto.

Referring to FIGS. 1 and 3 of the drawings, a guard rail 10 can be seen in FIG. 3 and a modified guard rail 11 in FIG. 1 of the drawings. The guard rail 10 is of a typical configuration secured to a post 12 by fasteners 13 as is well known in the art. The modified guard rail 11 is secured to a post 14 by fasteners 15 in the same manner.

Referring to FIG. 3 of the drawings, the modification of the guard rail 10 is indicated in broken lines. The modification comprises the reshaping of two generally convex portions 16 and 17 on the guard rail 10 into a pair of compound curves 20 and 21 respectively. The compound curves 20 and 21 define a pair of smaller spaced convex areas 22 and 23 adjacent each curve defining concave surfaces therebetween.

Figure 2:
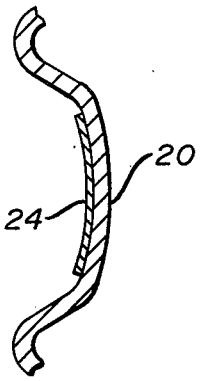
FIG. 2 is a partial section on lines 2–2 of FIG. 1.
Figure 4:
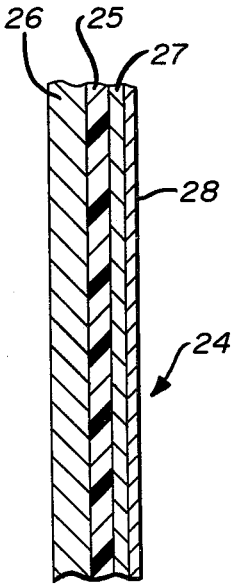
FIG. 4 is an enlarged cross section of the reflective strip.

Referring now to the modified guard rail 11, a pair of elastic reflective strips 24 are secured to the guard rail 11 within the compound 20 and 21 as seen in FIGS. 1 and 2 of the drawings. Each reflective strip 24 is comprised of a flexible and elastic synthetic resin base 25 best seen in FIG. 4 of the drawings. The synthetic resin base 25 can be made from a variety of resin materials well known in the art including acrylic acid esters such as polymethyl, methocrylate, and polybulyl, acrylate and others. The reflective strip 24 has an outer reflective surface 26 comprised of reflective glass levels and conventional materials well known in the art and a self-adhesive backing 27. The adhesive backing 27 is preferably one of the well known pressure sensitive adhesives compatable with the material of the guard rail 11 and the synthetic resin base material 25 and an example of such a material is a butyl-type adhesive which is preferably covered with a removable release paper 28. The elastic flexible nature of the reflective strips 24 allow the same to conform to the compound curves 20 and 21 of the guard rail 11 shaping the reflective strips 24 into a parabolic configuration. Such a shape enhances and concentrates the reflection of the light from an oncoming vehicle so as to improve the visibility of the guard rail. The parallel bands of the reflective strips 24 on the modified guard rail 11 will clearly indicate or mark the sides of a highway in both daylight and at night by reflecting the vehicle's headlights in a concentrated manner.

Referring again to FIG. 3 of the drawings, the guard rail 10 in solid lines is shown with a single large compound curve 29 along its center portion. A modified reflective strip 30 having the same characteristics as the ones hereinbefore described, is secured to the large compound curve 29. Apertures are formed along the length of the reflective strip 28 in spaced relation to one another to correspond to the fasteners 13 allowing the guard rail to be mounted in the usual manner so that the reflective strip 28 can be affixed to existing guard rails. The large concave curve 27 shapes the reflective strip 28 into a parabolic surface increasing its effectiveness to reflect the lights of the oncoming vehicles. The guard rail 11 and its reflective strips 24 combine to provide an improved safety system for highway use that combines the proven restraint capabilities of metal guard rails with a known effectiveness of reflective material to provide increased highway safety by clearly defining the safe path for vehicles in normally dangerous areas of the highway.

An additional benefit of the multiple concave curve configuration of the modified guard rail is its apparent ability to diminish the intensity of sound waves reflected from it back to the highway.

Thus having described my invention, what I claim is:

1. A guard rail and reflective strip for highway use in combination; a guard rail having a pair of longitudinally extending cross sectionally compound curved portions defining pairs of vertically spaced convex surfaces and at least one concave surface between said pairs of convex surfaces, said concave surface defines a generally parabolic surface, each of said pairs of vertically spaced convex surfaces defining a parabolic concave surface therebetween, a light reflecting strip comprising a base, a light reflecting material on one surface of said base, and an adhesive back on the other surface of said base, said base formed of a synthetic resin having an elastic quality, said flexible light reflective strip affixed continuously to said concave surfaces of said guard rail and means for securing said guard rail to a support means.

2. The guard rail and light reflecting strip of claim 1 wherein said reflecting strip conforms to the parabolic surface shape of said guard rail.

3. The guard rail and light reflecting strip of claim 1 wherein said light reflecting material includes glass beads.

4. The guard rail and light reflecting strip of claim 1 wherein said light reflecting strips are affixed continuously in said spaced parallel concave surfaces of said guard rail.

* * * * *